United States Patent [19]

Rank

[11] 4,062,335

[45] Dec. 13, 1977

[54] VARIABLE VOLUME PUMP FOR INTERNAL COMBUSTION ENGINE

[76] Inventor: William J. Rank, 1704 E. 58th St., Minneapolis, Minn. 55417

[21] Appl. No.: 616,591

[22] Filed: Sept. 25, 1975

Related U.S. Application Data

[60] Division of Ser. No. 475,392, June 3, 1974, abandoned, which is a continuation-in-part of Ser. No. 234,424, March 13, 1972, abandoned, which is a division of Ser. No. 41,320, May 28, 1970, Pat. No. 3,648,669.

[51] Int. Cl.[2] ..... F02M 39/00; F02D 1/02

[52] U.S. Cl. ..... 123/139 AP; 123/139 AB; 123/140 MC

[58] Field of Search ..... 123/139 R, 139 AB, 139 AR, 123/139 AY, 139 AP, 139 AW; 74/522

[56] References Cited

U.S. PATENT DOCUMENTS

| | | | |
|---|---|---|---|
| 1,395,851 | 11/1921 | McLean | 123/90.16 |
| 1,402,408 | 1/1922 | Firebauch | 123/139 R |
| 1,572,365 | 2/1926 | Rotter | 123/139 AB |
| 1,799,549 | 4/1931 | Evans | 123/139 AP |
| 2,026,009 | 12/1935 | Schneider | 123/139 AD |
| 2,071,719 | 3/1937 | Wirtele | 123/139 AL |
| 2,090,428 | 8/1937 | Schneider | 123/139 |
| 2,991,616 | 7/1961 | Miller | 123/90.15 |
| 3,648,669 | 3/1972 | Rank | 123/145 A |
| 3,669,085 | 6/1972 | Mayaki et al. | 123/140 MC |

FOREIGN PATENT DOCUMENTS

| | | | |
|---|---|---|---|
| 677,245 | 3/1930 | France | 123/139 AB |
| 387,483 | 12/1923 | Germany | 123/139 AP |
| 467,443 | 10/1928 | Germany | 123/139 AP |
| 408,760 | 4/1934 | United Kingdom | 123/139 |

*Primary Examiner*—Ronald H. Lazarus
*Assistant Examiner*—P. S. Lall
*Attorney, Agent, or Firm*—Burd, Braddock & Bartz

[57] ABSTRACT

An internal combustion engine with a nozzle for injecting fuel into the cylinder under pressure and across a heater which ignites the fuel as it enters the cylinder. A variable volume pump with a longitudinally movable control lever for varying the fuel volume provides fuel to the injector nozzle. A gear drive connects the pump with the engine crankshaft. The gear drive is operable in response to engine speed to change the phase relationship between the crankshaft and pump operator thereby controlling the timing of the injection of fuel into the cylinder. In one embodiment a pair of movable racks operate to control a plurality of levers to control a plurality of pumps.

31 Claims, 7 Drawing Figures

VARIABLE VOLUME PUMP FOR INTERNAL COMBUSTION ENGINE

REFERENCE TO RELATED APPLICATION

This application is a division of Ser. No. 475,392, filed June 3, 1974, now abandoned; and which is a C.I.P. of Ser. No. 234,424, filed Mar. 13, 1972, now abandoned; and which is a division of Ser. No. 41,320, filed May 28, 1970, now U.S. Pat. No. 3,648,669.

BACKGROUND OF THE INVENTION

There are two basic types of internal combustion piston engines. One of these is the Otto cycle wherein a mixture of fuel and air is drawn into a cylinder, is compressed and is then ignited by a spark plug with the resulting explosion or combustion of the fuel driving the piston to expand the chamber and to do work. The other common cycle is the Diesel cycle wherein air is compressed to a relatively high pressure and fuel is injected into the cylinder after the compression is substantially completed and ignites due to the temperature and pressure of the air into which it is injected.

Many variations of these basic cycles and many methods of improving their efficiency have been proposed. It is desired to improve this efficiency not only for economic reasons but also in order to assure substantially complete combustion and reduce the amount of unburned fuel which is exhausted by the engine as a potential air or water pollutent. Various additives for fuels have been used as have various means for controlling the injections and combustion of fuel. It has been proposed to have the fuel injected into the chamber through a spark gap, for example, in an effort to improve combustion. Various types of spark plugs and fuel injecting mechanisms have been proposed. Recently there has been proposed an engine which has a specially designed cylinder or piston to provide a special precombustion gas chamber with a glow wire disposed in it. This arrangement was proposed primarily for natural gas engines and required substantial modification of the engine.

In spite of the efforts to improve internal combustion engines, it is well known that there remains room for a great deal of improvement. This invention provides an improved apparatus for controlling the amount of fuel injected into the cylinders of an internal combustion engine.

SUMMARY OF INVENTION

The invention relates to a variable volume pump operable to deliver liquid fuel under pressure to an injector nozzle of an internal combustion engine. More particularly, the invention is directed to control means for varying the stroke of a pumping piston by longitudinally moving a piston actuating lever.

In one form of the invention the lever is mounted on pivot means slidably mounted on support means. The lever is movable relative to a reciprocating piston to change the distance between the pivot axis and the point of engagement between the lever and piston. This changes the stroke of the pumping piston.

In another form of the invention pivot means carries a plurality of levers engageable with separate pumping pistons. Cooperating gears and racks guide the pivot means for movement relative to the pistons. A control gear and drive racks are operable to move the pivot means in the guided path to change the effective lengths of the levers operating the pumping pistons. A governor or speed control is used to move one of the drive racks so that the pump is controlled in response to engine speed.

The control system preferably includes a pump which is operated in synchronism with the engine and which pressurizes fuel and supplies it to the nozzle which has incorporated therein a pressure operated valve which is opened by the pressurized fuel so that the fuel is injected at a desired and substantially constant pressure. The pump may be driven by the engine itself and preferably is constructed so it operates at a fixed rate with respect to the engine. The amount of fuel provided to the combustion chamber is controlled by varying the volume of the pump which in turn is dependent upon the stroke of a piston in the pump. The phase of the pump with respect to the engine may be varied with engine speed so that fuel injection, and thereby combustion, takes place at a predetermined point in the combustion cycle dependent upon r.p.m. of the engine.

The phase of the pump with respect to the engine may be varied by means of a planetary gearing arrangement and with a pressure responsive means, powered by a gear pump driven by the engine and responsive to its speed, connected to the planet gear to change the phase relationship between the input and output in response to changes in engine speed.

An object of the invention is to provide an improved apparatus for controlling combustion in an internal combustion engine. Another object of the invention is to provide a control system including a pump for providing fuel under pressure to a nozzle for injecting it into a combustion chamber. Another object of the invention is to provide a control system wherein throttling is accomplished by varying only the amount of fuel which is injected into the combustion chamber while the amount of air remains substantially constant. Another object is to provide a control system wherein substantially all the fuel is ignited as it enters the chamber thereby substantially eliminating the likelihood of detonation of the fuel and eliminating the need for additives such as tetraethylead to retard such detonation. Another object is to provide a variable volume piston-type pump with improved means for varying the stroke of the piston to thereby vary the volume of material moved by the pump. Another object is to provide a control system including means for controlling the phase (the point in the engine cycle) at which combustion begins. These and other objects of the invention will become apparent upon reading the detailed description of the invention which follows and wherein reference is made to the drawing.

DETAILED DESCRIPTION

Figures 1, 2, 3:
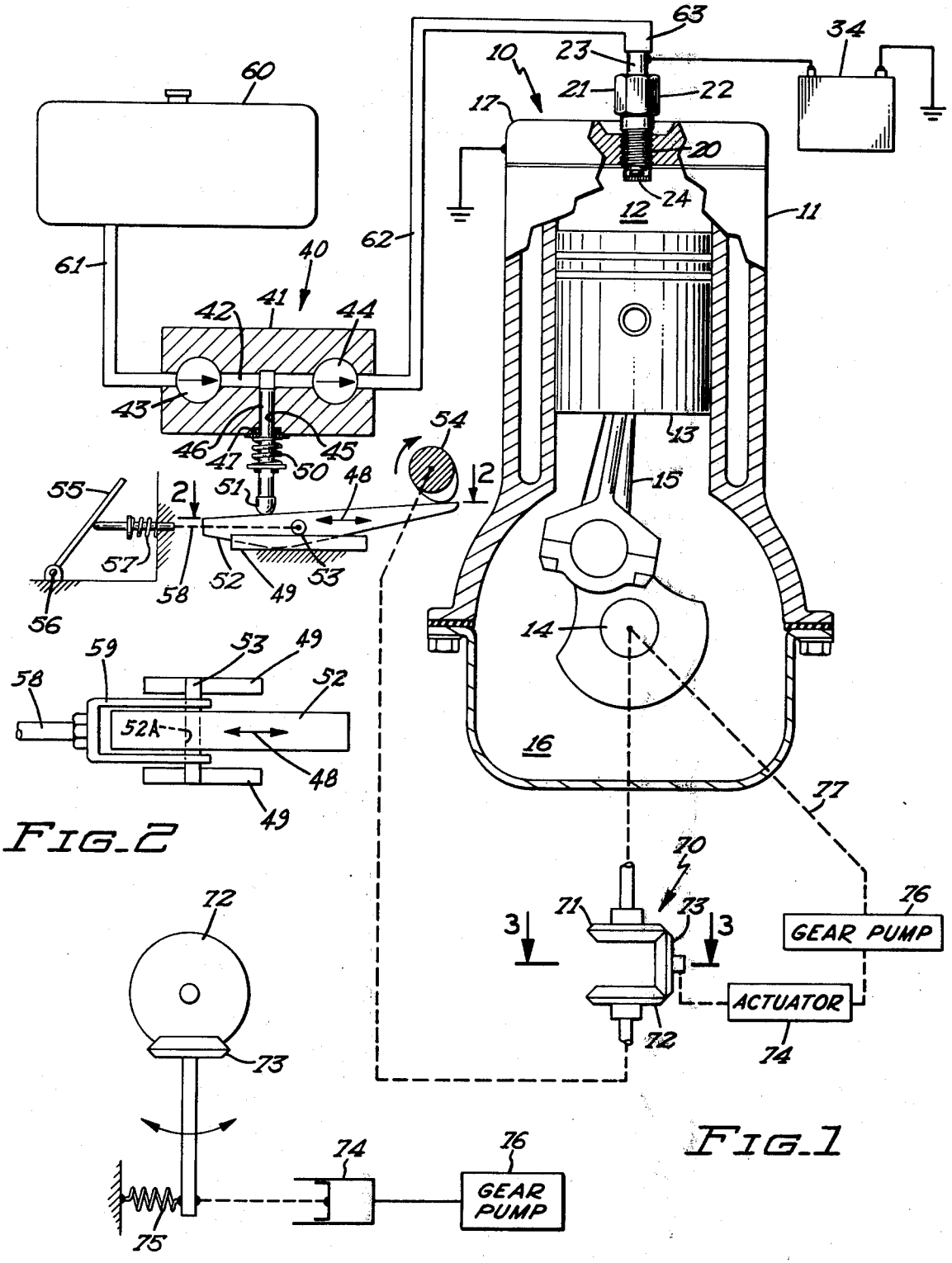
FIG. 1 is a schematic representation of an internal combustion engine and a fuel control system of this invention.
FIG. 2 is a plan view of the pump lever taken along line 2—2 of FIG. 1 looking in the direction of arrows.
FIG. 3 is a schematic showing in cross-section, taken generally along line 3—3 of FIG. 1 and showing a phase changing means which forms a part of the invention.

Referring to the drawing, numeral 10 generally designates an internal combustion engine of the piston type, shown schematically as a single cylinder engine having a block 11 with a bore 12 or cylinder in which a piston 13 reciprocates. Piston 13 is connected to a crankshaft 14 by a connecting rod 15. Crank shaft 14 is disposed in a crank case 16 at the lower end of the engine. At the upper end of the engine a head 17 encloses the end of bore 12 and has a port 20 threaded to accept an injector means 21. As indicated, engine 10 is shown schematically for purposes of illustration. No valves for admitting air or exhausting the products of combustion have been shown but it will be appreciated that some type of valving or porting arrangement must be provided for this purpose.

Instead of a spark plug being threaded into port 20, an injector means 21 is inserted there. Injector means 21 is disclosed in U.S. Pat. No. 3,648,669. The injector structures of U.S. Pat. No. 3,648,669 are hereby incorporated into this specification. These injector structures are operable to introduce a predetermined amount of fuel under pressure into the combustion chamber of the engine. Other types of fuel injector nozzles can be used with the variable volume pump and pump phase control of this invention.

Injector means 21 has a body member 22 connected to head 17 of the engine which is grounded. An inner member 23 extends through member 22 and is connected to an igniter 24. Member 23 is connected to one side of a power source 34 such as a battery, which has its other terminal grounded to supply power to the igniter 24.

A fuel pump 40 is also shown schematically in FIG. 1. Pump 40 includes a body 41 having a fluid passage 42 therethrough. At one end this passage has an inlet check valve 43 and at the other end an outlet check valve 44. These check valves may be of any conventional design, it being essential only that valve 43 permits the flow of fluid into the fluid passage in the pump but will not permit it to flow in the opposite direction out of the passage while valve 44 acts in an opposite direction, permitting fuel to egress from said passage only. Disposed in a passage or bore 45 in housing 41 which extends generally transversely to passage 42 and intersects passage 42 in between valves 43 and 44, is a pump piston 46 which is reciprocable in passage 45. Piston 46 is sealed with respect to passage 45 by appropriate means such as a sealing ring 47 and is urged in a direction outwardly from passage 45 by appropriate means such as a spring 50. The outer end of piston 46 is provided with an appropriately shaped end 51 which engages a lever 52. Lever 52 is pivoted about a fulcrum 53.

As shown in FIG. 2, fulcrum 53 is a pin projected through a transverse hole 52A in lever 52 whereby lever 52 is free to rotate about a transverse axis of the fulcrum 53. Fulcrum 53 projects laterally from both sides of lever 52. Each end of the fulcrum 53 bears against or rides on a fixed linear support 49 so that the lever 52 can move or slide linearly along the supports 49 as indicated by arrows 48 and is also operably engaged by an eccentric cam 54 which is connected to crankshaft 14 of the engine by appropriate means which have been shown schematically. This may be a direct connection whereby the cam 54 always has a fixed phase with respect to the crankshaft 14 or may include means for varying the phase between the crankshaft 14 and the cam 54 in response to engine speed as will be described hereinafter. Fulcrum 53 is disposed beween the points of engagement of lever 52 and piston 46 and leve 52 and cam 54. Lever 52 is longitudinally movable by operation of an appropriate control device such as a foot or a hand-operated throttle member 55. Member 55 may be pivoted about a pivot 56 and urged to a predetermined position by a spring 57. Throttle member 55 engages a rod 58 connected to a U-shaped yoke 59. Yoke 59 is pivotally connected to fulcrum 53 on opposite sides of lever 52. In the embodiment disclosed, throttle member 55 is urged in a counter-clockwise direction to an end position and may be moved in an opposite direction to move fulcrum 53 between piston 46 and cam 54. Movement of fulcrum 55 varies the relative lengths of the lever between the fulcrum 53 and the piston end 51 and between the fulcrum 53 and the cam 54 and thus varies the stroke of the piston 46 as the cam 54 rotates. Cam 54 will always move the lever 52 a predetermined angular distance during each revolution of the cam 54. The distance of movement of the piston 46 will depend upon the lever arm between it and the fulcrum. Therefore, the amount of fuel provided to the combustion chamber during each cycle is dependent upon the position of throttle member 55 and fulcrum 53 controlled thereby. It will be seen that if the pump 40 was designed so that fulcrum 53 could be moved to a position directly beneath piston 46 there would be substantially no displacement of piston 46 in that position.

Fuel is stored in an appropriate fuel tank 60 and is conveyed therefrom to inlet valve 43 by a fuel line 61. Similarly, fuel is conveyed from outlet check valve 44 by a fuel line 62 which includes a coupling means 63 adapted to engage the upper end member 23 to provide a fuel-tight connection so that fuel is provided by the pump 40 to injector means 21.

The fuel in tank 60 is preferably a liquid such as diesel fuel and is substantially uncompressible. Thus, operation of pump 40 does not compress the fuel any substantial amount but simply displaces and pressurizes it and thus causes it to exert a pressure on the injector means 21.

As indicated the connection between crankshaft 14 and cam 54 may be fixed so that the same phase relationship always exists between them. In many instances, however; it will be desirable to vary this phase relationship (and thus the point in the engine cycle where fuel injection and combustion takes place) in response to the speed of the engine. This may be accomplished by interposing in the connection between crankshaft 14 and cam 54 a planetary gearing arrangement 70 including an input gear 71 driven by the crankshaft 14 an output gear 72 driving cam 54, and an intermediate planet gear 73. Gears 71 and 72 are bevel gears arranged coaxially. Gear 73 is also a bevel gear with its axis normal to the axes of gears 71 and 72 and movable in an arc about the axes of gears 71 and 72. When the axis of gear 73 remains stationary, the phase between input and output gears 71 and 72 is constant. Movement of the axis of gear 73 will change this phase relationship and thus the point in the engine cycle at which pump piston 46 will be operated to inject fuel into the engine. The positioning of gear 73 may be accomplished by a pressure operated piston 74 acting against a biasing spring 75. Pressurized fluid is provided to piston 74 by a gear pump 76 which is driven by the engine as through appropriate drive means 77 shown schematically in FIG. 1. Pump 76 is constructed so that its output pressure is dependent upon its speed which in turn depends upon the speed of the engine. As the engine speed increases the pressure increases moving piston 74 against spring 75, thus moving gear 73.

Figure 4:
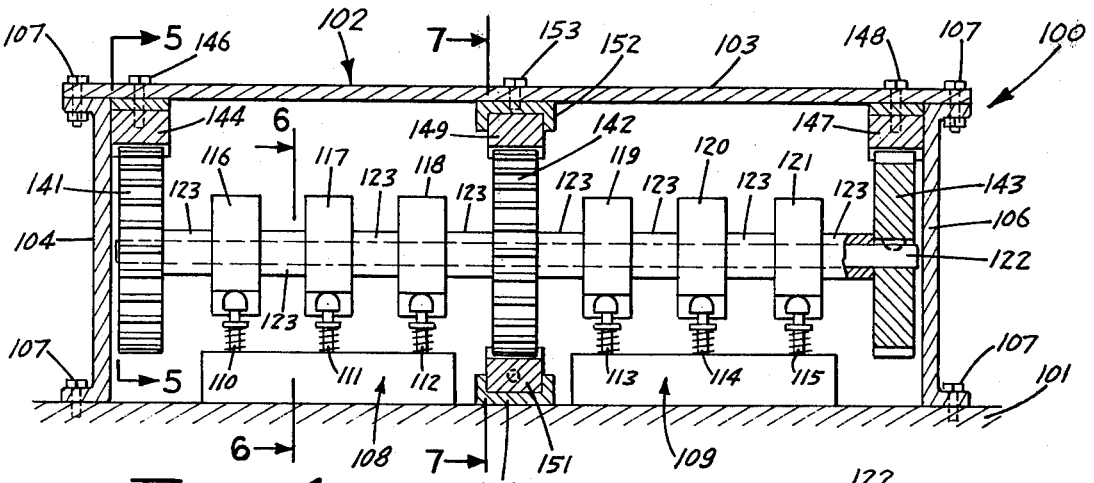
FIG. 4 is an elevational view, partly sectional, of a modification of the variable volume pump of the invention.
Figure 5:
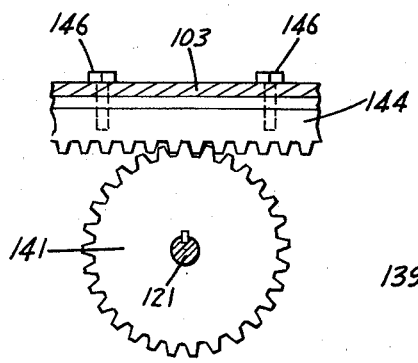
FIG. 5 is a sectional view taken along line 5—5 of FIG. 4.

Referring to FIG. 4, there is shown a fuel pumping unit indicated generally at 100 for a six cylinder engine of the type shown in FIG. 1. Pumping unit 100 is mounted on a support 101, as the block, head or frame of the engine. Unit 100 has a generally box-shaped frame 102 comprising a cross member 103 and end members 104 and 106. Nut and bolt assemblies 107 secure the end members 104 and 106 to cross member 103 and support 101. A pair of pump assemblies 108 and 109 are located within the box frame 102. Pump assembly 108 has three reciprocating pistons 110, 111 and 112. Pump assembly 109 has three reciprocating pistons 113, 114 and 115. Each of the pistons 110–115 are operated with separate levers 116–121, respectively. Levers 116–121 are pivotally mounted on a common shaft or fulcrum 122. Spacer sleeves or collars 123 are located between adjacent levers to hold the levers in spaced side-by-side relationship to each other. The levers and pistons for the pump assemblies 108 and 109 are identical in structure. A piston and lever arrangement is shown in FIG. 6.

Figure 6:
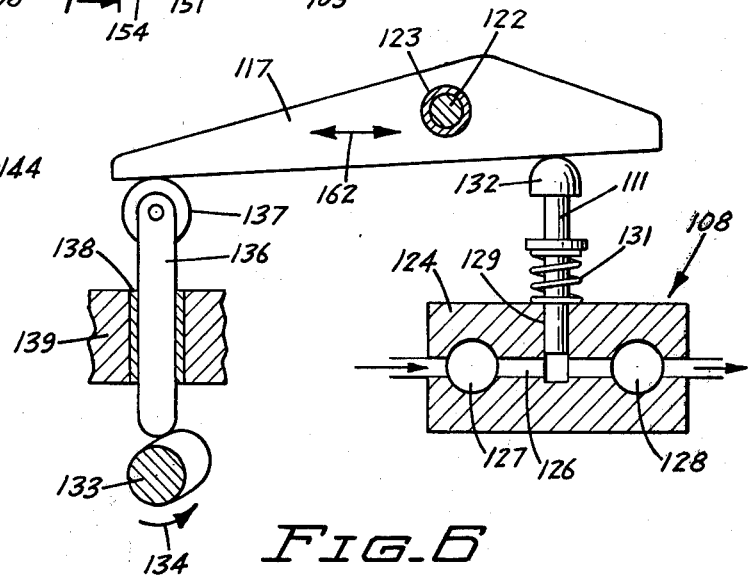
FIG. 6 is an enlarged sectional view taken along line 6—6 of FIG. 4.

Referring to FIG. 6, pump assembly 108 has a body 124 with a transverse fuel passage 126. A first inlet check valve 127 is located adjacent the inlet passage 126. An outlet check valve 128 is located adjacent the outlet of passage 126. The passage 126 is open to a transverse bore or passage 129 containing the forward end of the piston 111. A spring 131 located about piston 111 biases the piston 111 upward, or in an outward direction. The outer end of piston 111 has a semi-circular head 132.

Lever 117 is oscillated or angularly moved with the operation of a cam 133. Cam 133 is driven in the direction of arrow 134 through a power drive connected to the crankshaft of the engine in a manner as shown in FIG. 1. Other types of drives, such as a gear drive, belt drive or chain drive, can be used to rotate the cam 133. Cam 133 reciprocates push rod 136. The upper end of push rod 136 carries a rotatable roller 137. Roller 137 engages the end of lever 117. Push rod 136 is slidably disposed in a sleeve 138. Sleeve 138 is mounted on a support 139. Cam 133 can directly engage lever 117, as shown by cam 54 engaging lever 52 in FIG. 1.

The drive for cam 133 can include the planetary gearing arrangement 70 shown in FIG. 1. The gearing arrangement is operable to change the phase relationship of the cam relative to the crankshaft and thereby change the timing of the injection of fuel into the cylinders of the internal combustion engine.

Levers 116–121 and their shaft 122 are movably supported on frame 102 with a plurality of gears 141, 142, and 143 mounted on shaft 122. Gear 141 rides on a linear rack 144 located above gear 141. Bolts 146 secure rack 144 to cross member 103. The gear 141 has teeth which engage the linear teeth of rack 144. Gear 143 cooperates with a rack 147 located above gear 143. Bolts 148 secure the rack 147 to cross member 103 above the gear 143. The gears 141 and 143 and racks 144 and 147, respectively, are identical and support the opposite ends of the shaft 122.

The center gear 142 engages and upper linear rack 149 and a lower linear rack 151. Rack 149 rides in linear track 152. Bolts 153 secure the track to the midportion of cross member 103. The lower rack 151 rides in a linear track 154 secured to support 101. Tracks 152 and 154 are generally U-shaped members which slidably accommodate racks 149 and 151, respectively.

Figure 7:
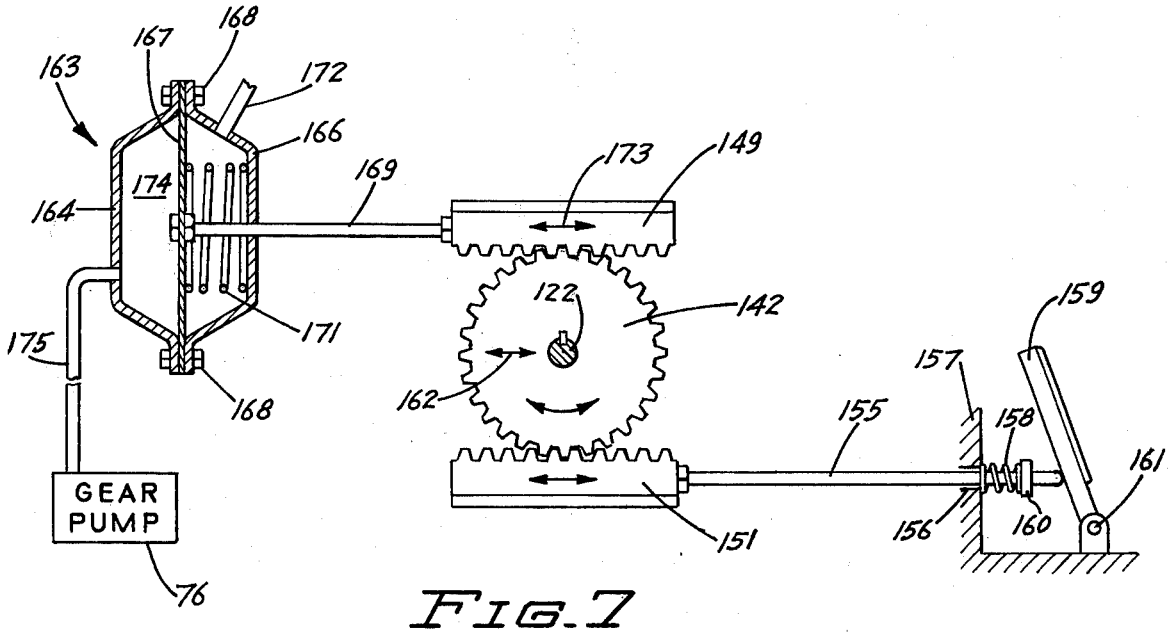
FIG. 7 is a sectional view taken along line 7—7 of FIG. 4.

As shown in FIG. 7, rack 151 engages the lower portion of gear 142 and is linearly moved in track 154 with a rod 155. Rod 155 extends through hole 156 in support 157. A spring 158 positioned about rod 155 and engageable with a stop member or collar 160 on the rod biases the rod 155 in an outward direction. The outer end of rod 155 engages a throttle member 159. The lower end of throttle member 159 is pivoted at 161 to a fixed support. Throttle member 159 is moved in an inward direction to force the rod 155 into the hole and thereby linearly move the rack 151. This will cause gear 142 to rotate and thereby linearly move shaft 122. The linear movement of shaft 122 carries the lever in a linear direction shown by arrow 162. This changes the lever arm or lateral distance between the axis of a shaft 122 and the piston head 132. Since cam 133 is of a fixed amptitude or offset distance, the lever 117 will have a constant angular movement. The change in the distance between head 132 and shaft 122 will change the amount of reciprocal movement of piston 111. This changes the amount of fuel that will be pumped through the passage 126. When the force on throttle member 159 is released spring 158 returns rack 151 to its initial or normal position.

Referring to FIG. 7, rack 149 is connected to a governor or speed control unit indicated generally at 163. Control unit 163 comprises a pair of facing cup-shaped members 164 and 166. A diaphragm 167 bisects and is attached to the cup-shaped members with a plurality of nut and bolt assemblies 168. A rod 169 is secured to the center of the diaphragm 167 and to one end of the rack 149 so that movement of the diaphragm 167 will move the rack 149 in the direction of arrow 173. A spring 179 biases the diaphragm in an outward direction. The chamber of the control unit 163 containing the spring is connected to an atmospheric vent 172. Chamber 173 of control unit 163 is connected with fluid line 175 to gear pump 76. Pump 76 is the same pump that operates the phase control structure 70, as shown in FIG. 1. The control unit 163 is operable to automatically control the amount of fuel that is injected into the internal combustion engine in response to the fluid pressure established by the gear pump 76. Gear pump 76 operates in direct response to the speed of the engine. This reduces and controls racing of the engine due to improper fuel control.

With the structure, a conventional internal combustion engine can be rendered more efficient, the potential air or water pollutents expelled thereby reduced, and the need for at least some of the additives normally utilized in its fuel eliminated. Preferably the apparatus includes a fuel injecting and igniting means which may be inserted into the conventional spark plug port without modification of the engine. A fuel pumping arrangement has also been disclosed in connection with the pump control system of the invention. While this pump is particularly adapted for use with the improved system, it may be used in other pumping environments. A phase changing means, varying the point at which combustion begins in accordance with engine speed has been disclosed. A four-cycle engine has been described but it will be obvious that the same system and apparatus may be applied to a two-cycle engine if desired. While the pump has been shown located remotely from the injection means, it will be appreciated that it may be incorporated into the injection means which then will be somewhat larger and will require a mechanical connection to a driving means such as the cam. These and various other modifications may become apparent to those skilled in the art in view of the disclosure herein. It is to be understood that the disclosure here is by way of example only and not of limitation, and that this invention is to be limited solely by the scope of the appended claims.

The embodiments of the invention in which an exclusive property or privelege is claimed are defined as follows:

1. A pump for use with an internal combustion engine having at least one cylinder, injector nozzle means for injecting fuel under pressure into the cylinder, said pump comprising: housing means having a chamber, a piston reciprocal in said chamber, oppositely acting check valves located in a passage in the housing providing an inlet and an outlet into said chamber whereby movement of said piston in one direction will draw fuel into said chamber at a relatively low pressure and movement of said piston in the other direction will pressurize the fuel and exhaust it through said outlet valve at a substantially greater pressure to the injector nozzle means, and means operable to reciprocate said piston through one stroke during each cycle of the engine cylinder, said means to reciprocate said piston including a lever extended generally normal to the direction of movement of said piston, said lever having transverse pivot means secured to the lever intermediate the ends of the lever, support means engageable with the pivot means to support the lever, said pivot means being movable with the lever relative to the support means in the direction of the longitudinal extent of the lever, said lever having one end portion slidably engageable with the piston, means slidably engageable with the other end portion of the lever operable to pivot the lever about the transverse axis of the pivot means to reciprocate said piston, means for linearly moving said lever in the direction of the longitudinal extent of the lever relative to the support means to change the relative distances between the pivot means and piston and pivot means and means operable to pivot the lever to thereby change the amount of reciprocal motion of the piston to vary the amount of fuel supplied to the nozzle means, means drivably connecting said means operable to pivot the lever to the engine, and means responsive to the speed of the engine to vary the phase relationship between said means operable to pivot the lever and the engine, independent of the means for linearly moving said lever.

2. The structure of claim 1 wherein: the means to pivot the lever comprises an eccentric cam engageable with the lever.

3. The structure of claim 1 including: means to bias the piston into engagement with a portion of the lever.

4. The structure of claim 1 including: seal means mounted on the housing means and engageable with the piston to hold the fuel in the chamber.

5. The structure of claim 1 wherein: the means for moving the lever is a throttle member.

6. The structure of claim 5 including: pivot means engageable with said throttle member mounting said throttle member for movement about a transverse axis.

7. The structure of claim 1 wherein: said pivot means comprise means projected laterally of said lever and engageable with said support means.

8. The structure of claim 1 wherein: the means to pivot the lever comprise rotatable cam means engageable with one end of said lever to oscillate said lever about the transverse axis of the pivot means.

9. The structure of claim 8 wherein: said cam means is drivably connected to the engine whereby said cam means is rotated by said engine, and said means responsive to the speed of the engine and independent of the means for linearly moving the lever, is connected to the cam means to vary the phase relationship between the cam means and the engine.

10. The structure of claim 1 wherein: the means to pivot the lever includes an eccentric cam and a push rod, said push rod engageable with the cam and lever.

11. The structure of claim 1 wherein: the means for linearly moving said lever includes a gear mounted on the pivot means, first and second means engageable with the gear, and means operable to move one of the first and second means to thereby move the gear to move the pivot means in a longitudinal direction.

12. The structure of claim 11 wherein: the first and second means are racks.

13. A pump for use with an internal combustion engine having at least one cylinder, injector nozzle means for injecting fuel under pressure into the cylinder, said pump comprising: housing means having a chamber, a piston reciprocal in said chamber, oppositely acting check valves located in a passage in the housing providing an inlet and an outlet into said chamber whereby movement of said piston in one direction will draw fuel into said chamber at a relatively low pressure and movement of said piston in the other direction will pressurize the fuel and exhaust it through said outlet valve at a substantially greater pressure to the injector nozzle means, means operable to reciprocate said piston through one stroke during each cycle of the engine cylinder, said means to reciprocate said piston including a lever extended generally normal to the direction of movement of said piston, said lever having transverse pivot means secured to the lever intermediate the ends of the lever, support means engageable with the pivot means to support the lever, said support means including gear means mounted on the pivot means, and fixed rack means engageable with the gear means to guide said gear means, said pivot means being movable with the lever relative to the support means in the direction of the longitudinal extent of the lever, said lever having one end portion slidably engageable with the piston, means slidably engageable with the other end portion of the lever operable to pivot the lever about the transverse axis of the pivot means to reciprocate said piston, and means for linearly moving said lever in the direction of the longitudinal extent of the lever relative to the support means to change the relative distances between the pivot means and piston and pivot means operable to pivot the lever to thereby change the amount of reciprocal motion of the piston to vary the amount of fuel supplied to the nozzle means.

14. The structure of claim 13 wherein: the means for linearly moving said lever includes a gear mounted on the pivot means, first and second racks engageable with the gear, and means operable to move one rack thereby moving the gear relative to the other rack to carry the pivot means in a longitudinal direction.

15. A pump for use with an internal combustion engine having at least one cylinder, injector nozzle means for injecting fuel under pressure into the cylinder, said pump comprising: housing means having a chamber, a piston reciprocal in said chamber, oppositely acting check valves located in a passage in the housing providing an inlet and an outlet into said chamber whereby movement of said piston in one direction will draw fuel into said chamber at a relatively low pressure and movement of said piston in the other direction will pressurize the fuel and exhaust it through said outlet valve at a substantially greater pressure to the injector nozzle means, means operable to reciprocate said piston through one stroke during each cycle of the engine cylinder, said means to reciprocate said piston including a lever extending a normal direction to the said piston, said lever having transverse pivot means secured to the lever intermediate the ends of the lever, support means engageable with the pivot means to support the lever, said suppor means including gear means mounted on the pivot means, and fixed rack means engageable with the gear means to guide said gear means, said pivot means being movable with the lever elevated to the support means in the direction of the longitudinal extent of the lever, said lever having one end portion slidably engageable with the piston, means slidably engageable with the other end of the lever operable to pivot the lever about the transverse axis of the pivot means to reciprocate the piston, means for linearly moving said lever in the direction of the longitudinal extent of the lever relative to the support means to change the relative distances between the pivot means and the piston and pivot means and means operable to pivot the lever to thereby change the amount or reciprocal motion of the piston to vary the amount of fuel supply to the nozzle means, said means for linearly moving said lever including a gear mounted on the pivot means, first and second racks engageable with the gear, and means operable to move one rack thereby moving the gear relative to the other rack to carry the pivot means in a longitudinal direction, and fluid pressure control means connected to the other rack to move the other rack whereby the gear moves relative to the one rack to carry the pivot means in a longitudinal direction.

16. The structure of claim 15 including: means to connect the fluid pressure control means to a fluid pressure source responsive to engine speed.

17. A pump for use with an internal combustion engine having at least one cylinder, injector nozzle means for injecting fuel under pressure into the cylinder, said pump comprising: housing means having a chamber, a piston reciprocal in said chamber, oppositely acting check valves located in said passage in the housing providing an inlet and an outlet to said chamber whereby movement of said piston in one direction will draw fuel into said chamber at a relatively low pressure and movement of said piston in the other direction will pressurize the fuel and exhaust it though said outlet valve at a substantially greater pressure to the injector nozzle means, and means operable to reciprocate said piston through one stroke during each cycle of the engine cylinder, said means to reciprocate said piston including a lever extended generally normal to the direction of movement of said piston, said lever having transfer pivot means secured to the lever intermediate the ends of the lever, support means engageable with the pivot means to support the lever, said pivot means being movable with the lever relative to the support means in the direction of the longitudinal extent of the lever, said lever having one end portion slidably engageable with the piston, means slidably engageable with the other end portion of the lever operable to pivot the lever about the transverse axis of the pivot means to reciprocate said piston, means for linearly moving said lever in the direction of the longitudinal extent of the lever relative to the support means to change the relative distances between the pivot means and piston and pivot means and means operable to pivot the lever to thereby change the amount of reciprocal motion of the piston to vary the amount of fuel supplied to the nozzle means, said means for linearly moving said lever including a gear mounted on the pivot means, first and second means engageable with the gear, means operable to move one of the first and second means to thereby move the gear to move the pivot means in said longitudinal direction, and fluid pressure control means connected to the first means to move the first means whereby the gear moves to carry the pivot means in a longitudinal direction.

18. The structure of claim 17 including: means to connect the fluid pressure control means to a fluid pressure source responsive to engine speed.

19. A pump for an internal combustion engine having at least one cylinder injector nozzle means for injecting fuel under pressure into the cylinder, said pump comprising: a housing means having a chamber, a reciprocating piston movable in said chamber, means to control the flow of fluid into and out of said chamber whereby on reciprocation of said piston the fuel is moved under pressure to said nozzle means, an operating lever extended generally normal to the direction of reciprocating movement of said piston, said lever having one end portion slidably engaging said piston, said operating lever having a pivot means secured to the lever permitting pivotal movement of the lever about a transverse axis, support means engageable with the pivot means supporting the lever for movement about said transverse axis spaced from said piston whereby rocking of said operating lever about said transverse axis causes said piston to reciprocate in said chamber, said pivot means being movable with the lever relative to the support means in the direction of the longitudinal extent of the lever means, a rotary eccentric cam cooperating with the other end portion of said operating lever on the opposite side of the pivot means from said piston and arranged so that upon rotation of said eccentric cam said operating lever is rocked about said transverse axis to reciprocate said piston one stroke during each cycle of the engine cylinder, and means for selectively moving the pivot means of said operating lever relative to the means supporting the lever to longitudinally move the lever to vary the relative lever arms between said cam and pivot means and said piston and said pivot means to thereby vary the stroke of said piston while said cam operates uniformly.

20. The structure of claim 19 including: means to bias the piston in one direction of its movement and continuously urge said piston into engagement with said operating lever, said operating lever being movable by the eccentric cam to move said piston in the opposite direction in opposition to said biasing means.

21. The structure of claim 19 including: seal means mounted on the housing engageable with the piston to hold the fuel in the chamber.

22. The structure of claim 19 wherein: said means for moving the lever includes a throttle member operable to longitudinally move the pivot means along the lever.

23. The structure of claim 19 wherein: the means for moving the pivot means includes a gear mounted on the pivot means, first and second means engageable with the gear, and means operable to move one of the first and second means to thereby move the gear to move the pivot means in a longitudinal direction.

24. The structure of claim 23 wherein: the first and second means are racks.

25. A pump for an internal combustion engine having at least one cylinder injector nozzle means for injecting fuel under pressure into the cylinder, said pump comprising: a housing means having a chamber, a reciprocating piston movable in said chamber, means to control the flow of fluid into and out of said chamber whereby on reciprocation of said piston the fuel is moved under pressure to said nozzle means, an operating lever extended generally normal to the direction of reciprocating movement of said piston, said lever having one end portion slidably engaging said piston, said operating lever having a pivot means secured to the lever permitting pivotal movement of the lever about a transverse axis, support means engageable with the pivot means supporting the lever for movement about said transverse axis spaced from said piston whereby rocking of said operating lever about said transverse axis causes said piston to reciprocate in said chamber, said pivot means being movable with the lever relative to the support means in the direction of the longitudinal extent of the lever means, a rotary eccentric cam cooperating with the other end portion of said operating lever on the opposite side of the pivot means from said piston and arranged so that upon rotation of said eccentric cam said operating lever is rocked about said transverse axis to reciprocate said piston one stroke during each cycle of the engine cylinder, and means for selectively moving the pivot means of said operating lever relative to the means supporting the lever to longitudinally move the lever to vary the relative lever arms between said cam and pivot means and said piston and said pivot means to thereby vary the stroke of said piston while said cam operates uniformly, and means drivably connecting said cam to the engine whereby said cam is rotated by said engine, and means responsive to the speed of the engine to vary the phase relationship between the cam and the engine, independent of the stroke of the piston.

26. The structure of claim 25 wherein: the support means includes gear means mounted on the pivot means, and fixed rack means engageable with the gear means to guide said gear means.

27. The structure of claim 26 wherein: the means for linearly moving said lever includes a gear mounted on the pivot means, first and second racks engageable with the gear, and means operable to move one rack, thereby moving the gear relative to the other rack.

28. A pump for an internal combustion engine having at least one cylinder injector nozzle means for injecting fuel under pressure into the cylinder, said pump comprising: a housing means having a chamber, a reciprocating piston movable in said chamber, means to control the flow of fluid into and out of said chamber whereby on reciprocation of said piston the fuel is moved under pressure to said nozzle means, an operating lever extended generally normal to the direction of reciprocating movement of said piston, said lever having one end portion slidably engaging said piston, said operating lever having a pivot means secured to the lever permitting pivotal movement of the lever about a transverse axis, support means engageable with the pivot means supporting the lever for movement about said transverse axis spaced from said piston whereby rocking of said operating lever about said transverse axis causes said piston to reciprocate in said chamber, said pivot means being movable with the lever relative to the support means in the direction of the longitudinal extent of the lever means, a rotary eccentric cam cooperating with the other end portion of said operating lever on the opposite side of the pivot means from said piston and arranged so that upon rotation of said eccentric cam said operating lever is rocked about said transverse axis to reciprocate said piston one stroke during each cycle of the engine cylinder, and means for selectively moving the pivot means of said operating lever relative to the means supporting the lever to longitudinally move the lever to vary the relative lever arms between said cam and pivot means and said piston and said pivot means to thereby vary the stroke of said piston while said cam operates uniformly, said support means including gear means mounted on the pivot means, and fixed rack means engageable with the gear means to guide said gear means, said means for linearly moving said lever including a gear mounted on a pivot means, first and second racks engageable with the gear and means operable to move one rack thereby moving the gear relative to the other rack, fluid pressure control means connected to the other rack to move the other rack whereby the gear moves relative to the one rack to carry the pivot means in a longitudinal direction.

29. The structure of claim 28 including: means to connect the fluid pressure control means to a fluid pressure source responsive to engine speed.

30. A pump for an internal combustion engine having at least one cylinder injector nozzle means for injecting fuel under pressure into the cylinder, said pump comprising: a housing means having a chamber, a reciprocating piston movable in said chamber, means to control the flow of fluid into and out of said chamber whereby on reciprocation of said piston the fuel is moved under pressure to said nozzle means, an operating lever extended generally normal to the direction of reciprocating movement of said piston, said lever having one end portion slidably engaging said piston, said operating lever having a pivot means secured to the lever permitting pivotal movement of the lever about a transverse axis, support means engageable with the pivot means supporting the lever for movement about said transverse axis spaced from said piston whereby rocking of said operating lever about said transverse axis causes said piston to reciprocate in said chamber, said pivot means being movable with the lever relative to the support means in the direction of the longitudinal extent of the lever means, a rotary eccentric cam cooperating with the other end portion of said operating lever on the opposite side of the pivot means for said piston and arranged so that upon rotation of said eccentric cam said operating lever is rocked about said transverse axis to reciprocate said piston one stroke during each cycle of the engine cylinder, and means for selectively moving the pivot means of said operating lever relative to the means supporting the lever to longitudinally move the lever to vary the relative lever arms between said cam and pivot means and said piston and said pivot means to thereby vary the stroke of said piston while said cam operates uniformly, said means for moving the pivot means includes a gear mounted on the pivot means, first and second means engageable with the gear, and means operable to move one of the first and second means to thereby move the pivot means in a longitudinal direction, and fluid pressure control means connected to the first means to move the first means whereby the gear moves to carry the pivot means in a longitudinal direction.

31. The structure of claim 30 including: means to connect the fluid pressure control means to a fluid pressure source responsive to engine speed.

* * * * *

UNITED STATES PATENT AND TRADEMARK OFFICE

CERTIFICATE OF CORRECTION

PATENT NO. : 4,062,335

DATED : December 13, 1977

INVENTOR(S) : William J. Rank

It is certified that error appears in the above-identified patent and that said Letters Patent are hereby corrected as shown below:

Column 3, line 61, "of" should be --on--.

Column 4, line 7, "leve" should be --lever--

Column 4, line 19, "55" should be --53--.

Column 6, line 1, "and" should be --an--.

Column 9, line 20, "suppor" should be --support--.

Signed and Sealed this

Fourth Day of April 1978

[SEAL]

Attest:

RUTH C. MASON
Attesting Officer

LUTRELLE F. PARKER
Acting Commissioner of Patents and Trademarks